US007195227B2

(12) United States Patent
Albers

(10) Patent No.: US 7,195,227 B2
(45) Date of Patent: Mar. 27, 2007

(54) VALVE ARRANGEMENT FOR A CONTAINER OPENING OR SIMILAR

(75) Inventor: Martin Albers, Sundern (DE)

(73) Assignee: Georg Menshen GmbH & Co., KG, Finnentrop (DE)

( * ) Notice: Subject to any disclaimer, the term of this patent is extended or adjusted under 35 U.S.C. 154(b) by 66 days.

(21) Appl. No.: 10/510,726
(22) PCT Filed: Apr. 4, 2003

(86) PCT No.: PCT/EP03/03549

§ 371 (c)(1),
(2), (4) Date: Oct. 7, 2004

(87) PCT Pub. No.: WO03/085299

PCT Pub. Date: Oct. 16, 2003

(65) Prior Publication Data

US 2005/0145814 A1 Jul. 7, 2005

(30) Foreign Application Priority Data

Apr. 8, 2002 (DE) ..... 20205418

(51) Int. Cl.
*F16L 37/28* (2006.01)

(52) U.S. Cl. ..... 251/149.1

(58) Field of Classification Search ..... 251/148, 251/149, 149.1, 149.6, 149.7, 151; 137/614.05; 604/905

See application file for complete search history.

(56) References Cited

U.S. PATENT DOCUMENTS

| | | | | |
|---|---|---|---|---|
| 4,340,080 | A * | 7/1982 | Lefrancois | 137/223 |
| 4,429,856 | A * | 2/1984 | Jackson | 251/149.1 |
| 4,436,125 | A * | 3/1984 | Blenkush | 251/149.6 |
| 5,293,902 | A * | 3/1994 | Lapierie | 251/149.6 |
| 5,772,263 | A * | 6/1998 | Lewis | 285/319 |
| 6,050,978 | A * | 4/2000 | Orr et al. | 604/249 |
| 6,279,874 | B1 * | 8/2001 | Nyberg | 251/149.6 |

* cited by examiner

*Primary Examiner*—Eric Keasel
(74) *Attorney, Agent, or Firm*—Andrew Wilford

(57) ABSTRACT

A valve has a base body fitted in an opening and having a through passage formed at one end with a first valve surface. A valve element in the base body and has axial ends one of which forms second valve surface sealingly fittable with the first valve surface to close the through passage. A stem in the through passage is coupled to the valve element to move it between the closed and open positions. A plurality of abutment arms projecting inward from an inner peripheral wall of the through passage define with a shaft region of the valve element a clearance and define a radial gap between opposite arms which is greater than a radial dimension of the shaft region and smaller than a radial dimension of a shoulder of the valve element.

5 Claims, 2 Drawing Sheets

VALVE ARRANGEMENT FOR A CONTAINER OPENING OR SIMILAR

CROSS REFERENCE TO RELATED APPLICATIONS

This application is the US national phase of PCT application PCT/EP03/03549, filed 4 Apr. 2003, published 16 Oct. 2003 as WO 03/085299, and claiming the priority of German patent application 20205418.7 itself filed 8 Apr. 2002.

FIELD OF THE INVENTION

The invention relates to a valve arrangement comprised of a base body for mounting on an opening to be closed of a container, tube or the like.

It relates especially to a valve arrangement which enables the introduction and/or the withdrawal of a liquid, gaseous or pulverulent fluid into or out of a container or bag by means of a stem or a needle actuated from the exterior and which can be connected with a tube or the like through which the fluid can be fed in or carried off. These operations are usually automatically controlled and carried out in tight spaces.

BACKGROUND OF THE INVENTION

A valve arrangement of this type is known (WO 98/48203) and has a valve element which is provided externally of a fluid through passage of the valve arrangement. This requires expensive structural features which complicate fabrication and mounting and are counterproductive to efforts to minimize the dimensions of the valve arrangement. It is also known (WO 95/23972) to provide a one-piece arrangement, instead of separately fabricated components, whereby the valve element is also located outside of the fluid through passage. Indeed, the fabrication is facilitated by the one-piece construction, but the valve arrangement does not otherwise differ materially from the prior two-part arrangement and can result in burrs or the like in production which can influence the sealing function of the valve arrangement. With respect to the state of the art, reference can also be made to U.S. Pat. Nos. 3,768,501 and 3,871,422.

OBJECTS OF THE INVENTION

Through the invention a valve arrangement of the type described at the outset should be obtainable with a satisfactory sealing, which is robust and with a minimum of structure.

In addition the components of the valve arrangement should be fabricatable economically by injection molding and assembled with few steps, preferably automatically, to a complete unit.

SUMMARY OF THE INVENTION

These objects are attained in that a shaft region of the valve element defines a clearance with inwardly extending abutment arms projecting from the inner peripheral wall of the through passage and has a radial gap between opposite arms which is greater than the radial dimensions of the shaft region and smaller than those of a shoulder of the valve element so that the shoulder can engage the abutment arms upon movement of the valve element into the open position and the abutment arms limit the opening movement of the valve element, the abutment arms being elastically yieldable to exert a force opposing the opening movement of the valve element.

The invention enables the preparation of a valve arrangement in which the valve element lies within the outline of the base body, for example a tube segment, or weld-in parts can be arranged so that its position is not relinquished either in the closed position or the open position of the valve. This permits minimizing the construction of the valve arrangement below the dimensions of the bore or the opening cooperating with the valve arrangement so that a flow-blockage can be provided as is customary. Simultaneously the valve arrangement is less susceptible to breakdown as a result of external influences than hitherto known arrangements, since no parts extend to the exterior and have exposed walls even when the container is emptied. The important components of the valve arrangement, namely the base body and the valve element can be composed of molded plastic parts which are easy to produce economically. Their mounting can be effected in a single step, preferably automatically.

BRIEF DESCRIPTION OF THE DRAWING

The invention is described below in greater detail with reference to an embodiment and the drawing. It shows.

SPECIFIC DESCRIPTION

Figure 1:
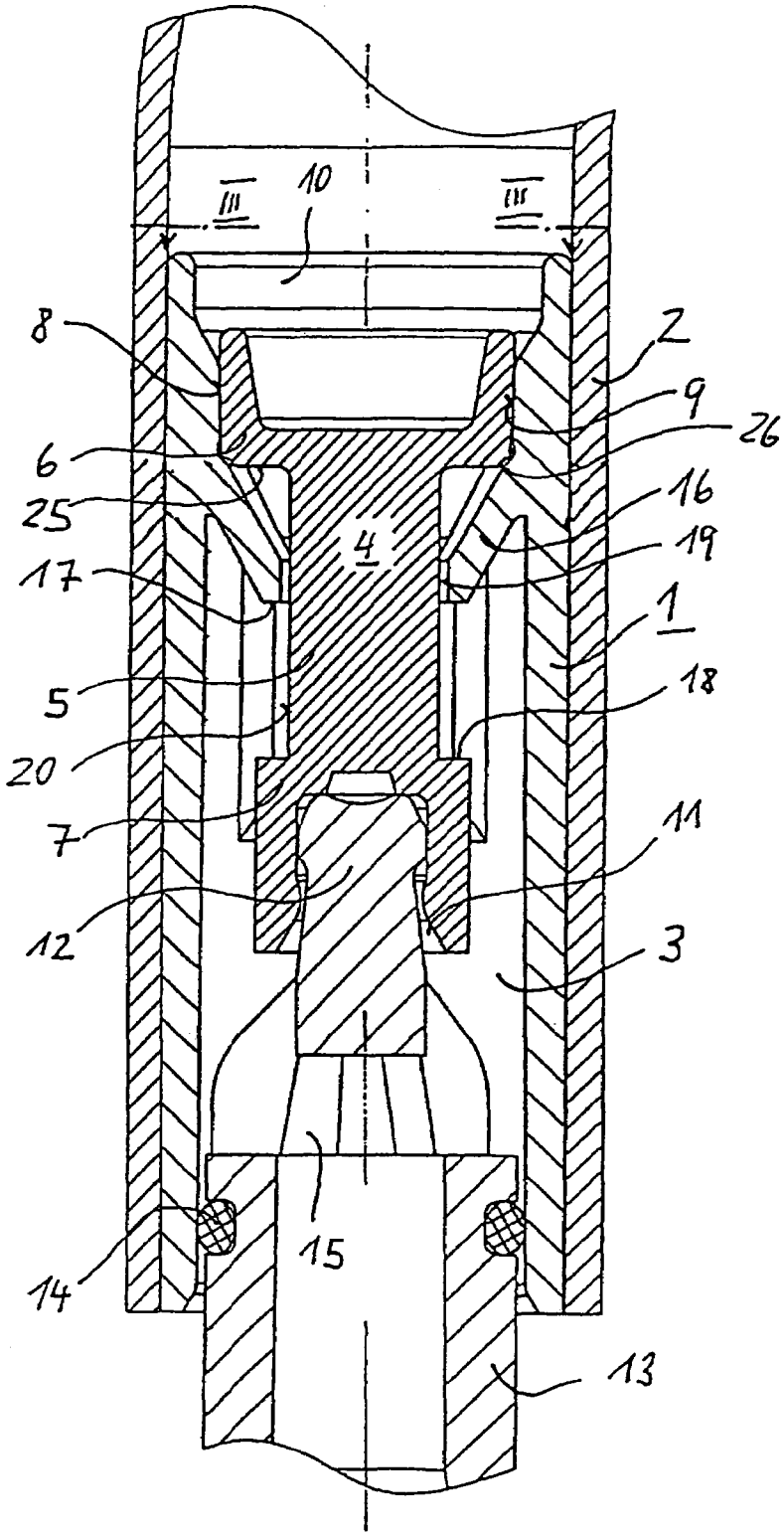
FIG. 1 a valve arrangement according to an embodiment of the invention, in a longitudinally sectioned elevational view, mounted in a tube which can be sealed off.

While the invention is described below in conjunction with the sealing of a tube in which the valve arrangement is inserted as a kind of plug and, for example, is held sealingly in place by a press seat, the invention is not limited to this use. Rather the valve arrangement can be configured also in other ways, especially as a weld-in part for insertion in a slit-shaped opening of a container of foil or film like material where it can be sealingly connected with the container by welding or in another appropriate way. The basic construction as a welded-in part is known to an artisan so that a more detailed explanation of it is superfluous.

The valve arrangement comprises, as shown, a tube-shaped base body 1 which is inserted in a tube 2 as a kind of plug. The base body 1 is traversed by a through going passage 3 which extends from one axial end of the base body 1 to its other axial end. In the through passage 3 a valve element 4 is arranged which has a central shaft region 5 with a reduced radial diameter $D_1$ which extends between thicker regions with greater peripheral dimensions located at its ends 6 and 7. One of the thicker regions 6 can have a cup-shaped or bowl-shaped configuration and has a peripheral surface 8 forming a first valve surface. A further inner peripheral surface 9 is provided at a mouth region or end region 10 of the base body 1 proximal to an axial end of the through passage 3 and forms a further valve surface. Between the valve surfaces 8 and 9 a seal is provided when the valve element 4 is in the closed position shown in the drawing in which the through-passage 3 is sealed off.

The other opposite thickened region 7 of the valve element 4 has a shaped or profiled recess 11 opening away from the shaft region 5 and in which a profiled head part 12 of a tubular stem element 13 can engage and which serves to couple to the valve device a filling device or evacuating device for a medium. The stem element 13 can be inserted in the through passage 3 from the side of its other axial end and can be connected with a tube or hose (not shown) through which a fluid can pass. On the outer periphery of the stem element 13, a seal 14 having the shape, for example, of an O-ring, can be arranged and can serve to provide a sealing relationship with a neighboring portion of the inner periphery of the base body 1.

In the peripheral wall of the stem element 13, close to the head-part 12, are gaps or interruptions 15 through which the fluid can flow from the interior of the stem element 13 into the through passage 3. The stem element 13 can, if required, be extended out of the coupled engagement with the valve element 4. From the inner periphery of the base body 1 close to the second valve surface 9, a plurality, preferably four uniformly peripherally spaced abutment arms 16 can run at an inclination inwardly and in a direction toward the thickened region 7 of the valve element 4. The abutment arms 16 have axial abutment surfaces 17 with which a ring-shaped shoulder surface 18 of the thickened region 7 of the valve element 4 can come into engagement to limit the axial mobility of the valve element 4 in the direction of its opening position in which the first valve surface 8 is out of sealing engagement with the second valve surface 9. The axial shifting of the valve element 4 can be effected by a displacement of the valve element 4 with the stem element 13 which is coupled therewith in the throughpassage 3.

Figure 3:
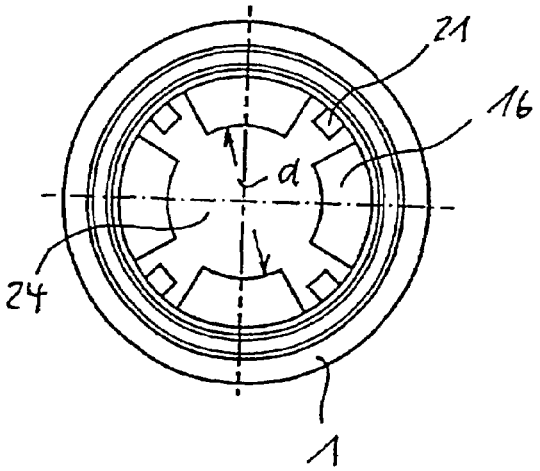
FIG. 3 a view of the valve arrangement along the line III—III in FIG. 1 with the valve element removed.

In the illustrated rest or operating position, the abutment arms 16 terminate at a short distance or spacing from the outer periphery 20 of the shaft region 5 of the valve element 4 as is indicated at 19 so that between the arms 16 and the valve element 4 no continuous contact can occur. The arms 16 are so dimensioned that, under an axial force applied thereto by the shoulder 13 they can bend outwardly and thus yield. In the rest or operating position the abutment arms 16 define a free inner clearance 24 with a gap width d (compare FIG. 3).

Figure 2:
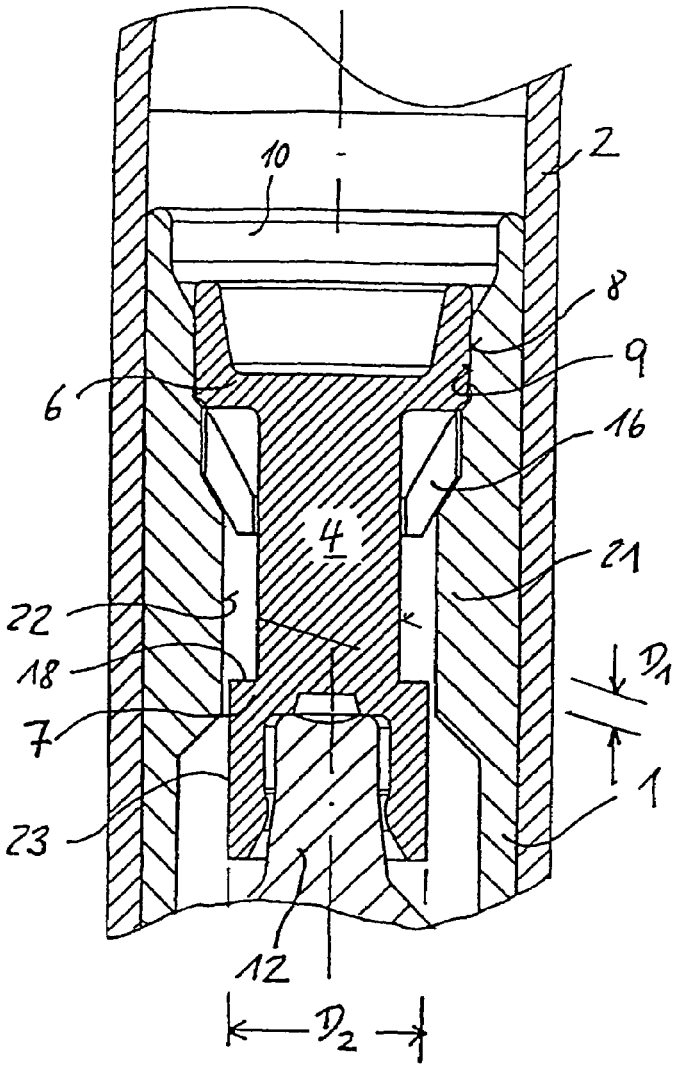
FIG. 2 the valve arrangement of FIG. 1 in an elevational view rotated through 45°.

FIG. 2 further illustrates that on the inner periphery of the base body 1 a multiplicity of guide strips 21 (preferably four strips) can be provided in equal peripheral spacings from one another, to extend in the axial direction and have inner guide surfaces 22 along which the thickened region 7 of the valve element 4 is moved. The radial dimension $D_2$ of the outer periphery 23 of the thickened region 7 is such that a minimal free space to the guide surface 22 of the guide strips 21 is maintained and the thickened region 7 only rides against them when the valve element 4 is caused to pass out of its predetermined axial and radial orientation by external disturbing forces.

As has been illustrated in the drawing, the valve element 4 both in its open position and its closed position is received within the peripheral and axial boundaries of the through passage 3 or the base body 1. This is made possible by the yieldable abutment arms 16 which can bend outwardly upon insertion of the valve element 4 in the through passage 3 from the side of the mouth region 10 thereby enlarging the width d to enable the thickened region 7 of the valve element 4 to pass the abutment arms 16. The abutment arms 16 then spring back into their illustrated starting positions and serve as an abutment, limiting movement of the valve element 4 into the open position and simultaneously preventing the valve element 4 from falling out of the throughpassage 3.

The closed position which is defined by the engagement between the first and second valve surfaces 8 and 9 can be limited in other appropriate ways by, for example, having the valve element engage with a shoulder 26 against the base body 1, close to the second valve surface 9.

While the invention enables complete integration of the valve element within the throughpassage of the base body it is not limited in this respect. The first and second valve surfaces can also be extended externally of the axial ends of the through passage by forming an abutment flange on the valve element with a sealing surface which can engage with an end sealing surface of the base body in a sealing relationship. The sealing relationship can be maintained exclusively by the effect of an overpressure in the container. Instead of four or more abutment arms and guide strips, also a pair of diametrically opposite abutment arms and guide strips can be provided. The base body and the valve element are preferably separately injection molded synthetic resin or plastic part of the same or different plastic material.

The invention claimed is:

1. A valve arrangement comprised of a base body for mounting at an opening to be closed of a container or tube, the base body having a through passage with axial ends and close to one axial end of the through passage a first valve surface, a valve element held by the base body and having axial ends and forming a second valve surface proximal to one of its axial ends which can sealingly engage with the first valve surface to close the through passage, the valve element being movable relative to the base body between a closed position with the valve surfaces sealingly engaging each other and an open position, a stem element which engages in the through passage from the side of its other axial end and has first coupling means for releasable engagement with second coupling means on the valve element in order to move the valve element from the closed position into the open position, the base body and the valve element being separate molded parts, and a plurality of abutment arms projecting inward from an inner peripheral wall of the through passage, defining with a shaft region of the valve element a clearance, and defining a radial gap between opposite arms which is greater than a radial dimension of the shaft region and smaller than a radial dimension of a shoulder of the valve element so that the shoulder can axially engage the abutment arms upon movement of the valve element into the open position and the abutment arms limit the opening movement of the valve element, the abutment arms being elastically yieldable to exert a force opposing the opening movement of the valve element.

2. The valve arrangement according to claim 1 characterized in that a thickened end region at one end of the shaft region of the valve element close to its opposite axial end is the end region that has the second coupling means.

3. The valve arrangement according to claim 1, characterized in that the second valve surface is provided on a thickened end region close to an axial end of the valve element with a radial dimension which is greater than that provided by the abutment arms and the radial dimension of the thickened end region of the valve element at its other axial end.

4. The valve arrangement according to claim 1, characterized in that at least a pair of diametrically opposite abutment arms are provided.

5. The valve arrangement according to claim 1, characterized in that the valve element is arranged within the axial and peripheral bounds of the through passage.

* * * * *